United States Patent [19]

Smith

[11] 3,963,109

[45] June 15, 1976

[54] SINGLE ELEMENT TYPEHEAD POSITIONING MECHANISM

[75] Inventor: William J. Smith, West Hartford, Conn.

[73] Assignee: Royal Business Machines, Inc., Hartford, Conn.

[22] Filed: June 9, 1975

[21] Appl. No.: 585,051

[52] U.S. Cl. ..... 197/55; 197/18

[51] Int. Cl.[2] ..... G41J 1/32

[58] Field of Search ..... 178/23 R, 33 R, 34; 197/16, 18, 49–55

[56] References Cited

UNITED STATES PATENTS

| | | | |
|---|---|---|---|
| 2,661,683 | 12/1953 | Beattie | 197/52 X |
| 3,201,514 | 8/1965 | Kleinschmidt et al. | 197/18 UX |
| 3,467,233 | 9/1969 | Jablonski | 197/18 X |
| 3,596,746 | 8/1971 | Murat | 197/18 X |
| 3,616,888 | 11/1971 | Kawano et al. | 197/18 |

*Primary Examiner*—Edgar S. Burr
*Assistant Examiner*—Paul T. Sewell
*Attorney, Agent, or Firm*—Joseph R. Spalla

[57] ABSTRACT

A non-homing positioning mechanism to effect type selective movements of a single element typehead by means of coordinate band systems wherein the coordinate band systems are cntrolled by a translator comprising a four armed cross-shaped member unidirectionally rotatable in 90° steps. A set of radially spaced pins are arranged along opposing arms of the cross-shaped member, the sets being alternately selectively settable in response to successive character selections to cause selective band displacement incident to each 90° rotation of said cross-member. One end of each band system is anchored and the other end is connected to position and hold the typehead to a selected character in accordance with the displacement thereof through selected pins on opposing arms of and incident to movement of the cross-shaped member.

10 Claims, 12 Drawing Figures

Fig_2
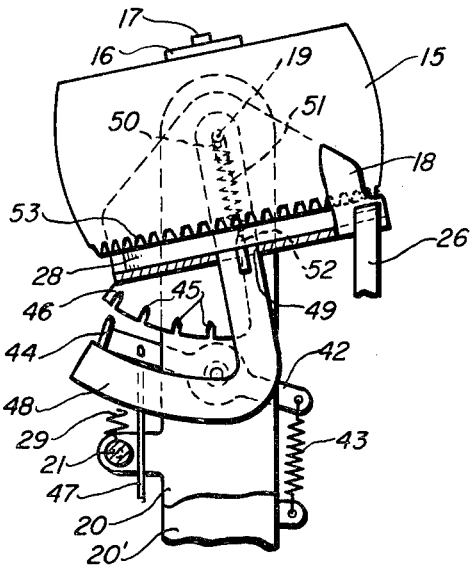
Fig_6
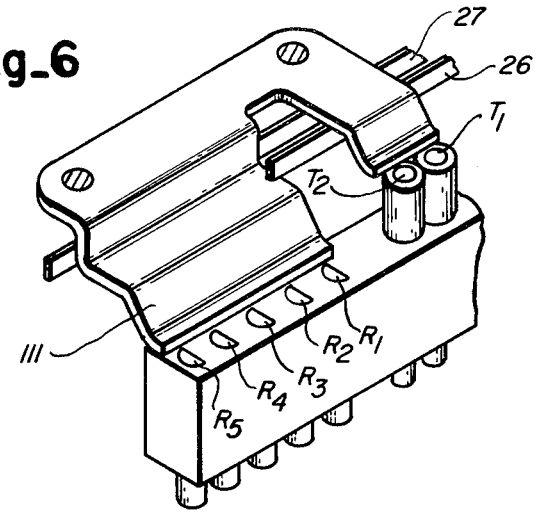
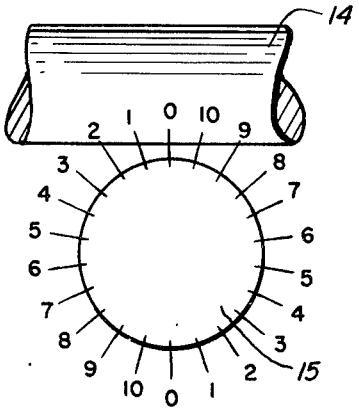
Fig_8
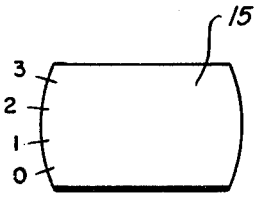
Fig_9

Fig_3
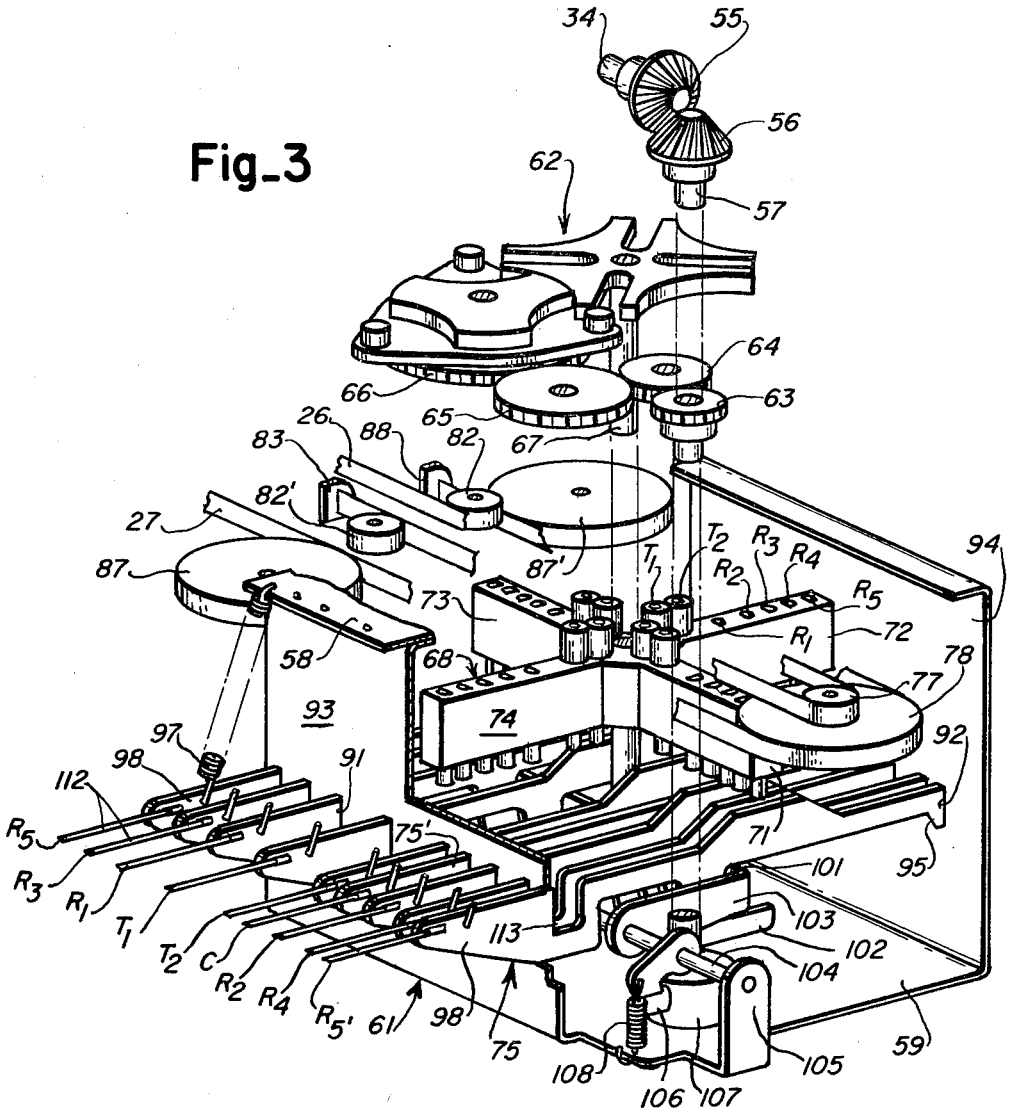
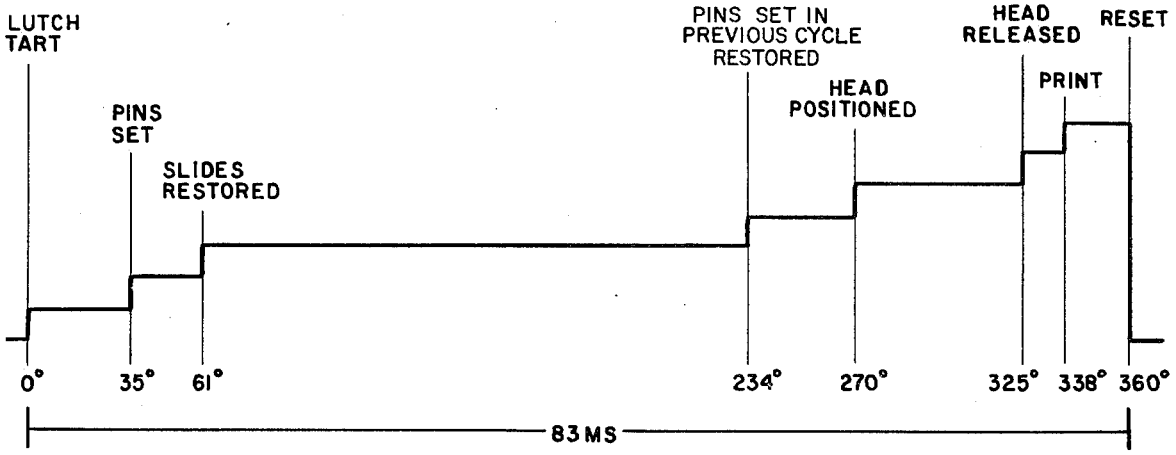
Fig_12

121
119
76
110
114
115
116
$R_5$
$R_3$
$R_1$
117
$T_1$
$T_2$
C
$R_2$
$R_4$
$R_5'$
117
118
112

55
56
62
64
58
26
65
63
57
111
111
68
27
72
74
97
71
89
93
94
98
113
104
96
101
75
95
92
91
61
103
102
67
59
108
106
105
107

SINGLE ELEMENT TYPEHEAD POSITIONING MECHANISM

This invention relates to positioning mechanism for positioning a single element typehead; more particularly, it relates to positioning mechanism having a band anchored at one end and connected at its other end to the single element typehead; and specifically, it relates to positioning mechanism having a band which is selectively displaceable by rotation of a single member having radially spaced settable pins thereon to control band displacement.

Single element typehead positioning mechanism are known to the art which employ band systems controlled by differential pully systems wherein movement of selected pulleys selectively displace the band system to position the typehead. Such systems are complicated and subject to inaccuracies in positioning.

In accordance with the present invention, a band system associated with each coordinate movement of a typehead has one end anchored which extends from the anchor to a fixed turn around pulley with its other end connected to a spring biased coordinate positioning structure, e.g. tilt or rotate, thereby forming a loop. The loop in each band system is located along opposing arms of a four armed cross-shaped member. Opposing arms support radially spaced pins therein which are selectively axially movable into the plane of the loops in response to a character selection thereby to displace the band systems when the cross-shaped member is rotated 90° thereby to position and hold the typehead positioned with a selected character opposite a print point. During each 90° rotation of the cross-shaped member, pins located on the 90° spaced opposing arms of the cross-shaped member and representing the next character can be selected to be set in while the printing cycle of the first positioned character is in progress, and, in the next cycle, be set in to displace the band.

An object of the invention is to provide a simplified single element typehead positioning mechanism.

Another object of the invention is in the provision of a non-homing single element typehead positioning mechanism.

Still another object of the invention is to provide a novel translating mechanism for converting digital input to analogue output for positioning a single element typehead.

Still another object of the invention is in the provision of a translator which can accept and hold in memory a second character code while the first entered code is being translated to position a single element typehead.

A further object of the invention is in the provision of a translator for a single element typehead positioning mechanism which can accept and store in memory the code for a subsequent character while the printing cycle of the first character set in is in progress thereby to reduce the cycle time for character selection and acceptance.

Other objects and many of the attendant advantages of the present invention will be readily appreciated as the same becomes better understood by reference to the following detailed description when considered in connection with the accompanying drawing in which like reference numerals designate like or correspondng parts throughout the Figures thereof and wherein:

FIG. 2 is a side elevational view of the detent structure of the single element typehead;

FIG. 3 is a perspective view of a translator mechanism for selectively displacing the bands in FIG. 1 in accordance with code inputs from a keyboard;

FIG. 6 is a perspective view showing details of the pin restoring mechanism of the translator;

FIGS. 8 and 9 are schematic views of rotate and tilt positions on a typehead;

FIG. 12 is a timing diagram of events in a cycle.

Figure 1:
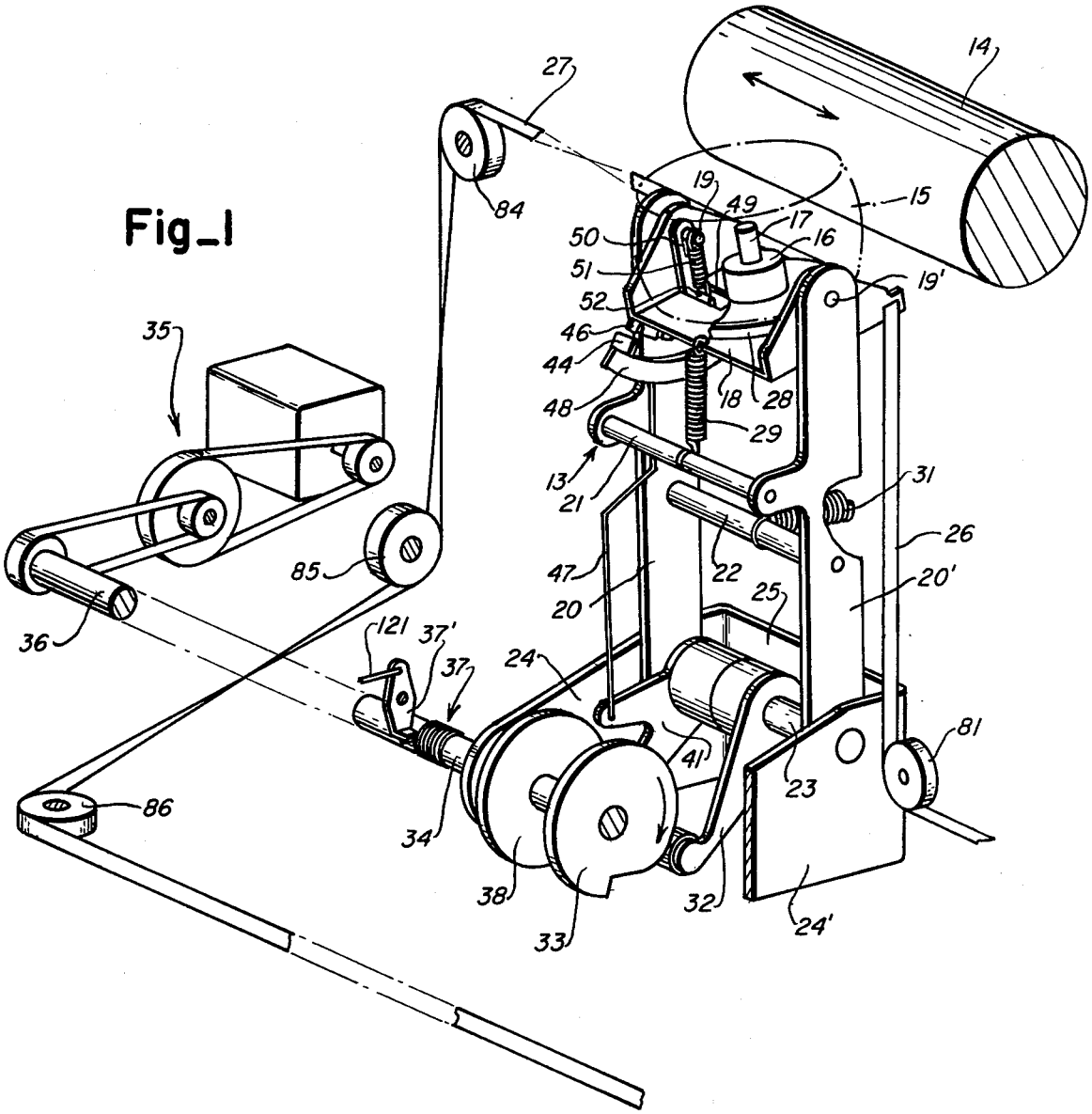
FIG. 1 is a perspective view of a single element typehead positioning structure wherein the tilt and rotate positioning structures are operated by selectively displaced bands.

Referring now to the drawing wherein a preferred embodiment of the positioning and translating mechanism is illustrated, there is shown in FIG. 1 a single element typehead assembly generally designated by reference numeral 13 supported centrally of a machine frame which supports a movable platen 14, though the invention may as easily be incorporated with an assembly 13 mounted for movement relative to a fixed platen machine. The assembly 13 comprises a typehead 15 supported on and for rotation with a mounting shaft 16 rotatably supported on a shaft 17 extending upwardly from a tilt bridge 18. The tilt bridge 18 is pivotally mounted as by pins 19, 19' for tilting movement on a pair of upwardly directed arms 20, 20', which are spaced by cross rods 21 and 22, and which are secured at their lower ends on a shaft 23 pivotally supported by spaced arms 24, 24' of a frame supported bracket 25. The shaft 23 defines the axis about which the single element typehead assembly 13 may be swung to print a selected character on the typehead 15 against the platen 14. A tilt band 26 is connected to the tilt bridge 18 to rock the tilt bridge 18 and thereby tiltably position a selected one of four circumferential rows of type 0, 1, 2 or 3 (FIG. 9) on the head periphery opposite a print point, and a second or rotate band 27 is connected to a rotate pulley 28 coaxially secured to the shaft 16 supporting the typehead 15 thereby to rotatably position a selected one of eleven columns of type (FIG. 8) on the periphery of the typehead 15 opposite the platen 14. As is conventional, the rotate pulley 28 comprises the periphery of a drum wherein a clock spring connected to the drum and to shaft 17 serves to normally rotatably bias the typehead 15 in one direction to a zero position (FIG. 8).

With continuing reference to FIG. 1, the tilt bridge 18 is connected as by a spring 29 to the cross-shaft 21 thereby to bias the tilt bridge 18 in one direction to the zero position (FIG. 9). Also as shown in FIG. 1, a power spring 31 is connected to the other cross-shaft 22 and to an anchor (not shown) on the machine frame. As shown, the shaft 23, defining the swing axis, carries a cam follower 32 which is associated with a cam 33 mounted on a cycle shaft 34 rotatably supported by the bracket arms 24, 24' forwardly of the shaft 23. The cycle shaft 34 is adapted to be driven from a motor source generally designated by reference 35 and located to the left side of the machine. The output shaft 36 of the motor source is coupled to the cycle shaft 34 by way of a one revolution clutch generally designated by reference numeral 37 which may take the form of a wrap spring clutch held disengaged by an interponent 37'. In the clutch disengaged position shown, the position of cam 33 is such that its follower 32 is held in a counterclockwise position thereby to store power in the power spring 31. When the clutch is released or engaged and the cam 33 rotates through a predetermined angle, the power stored in spring 31 is released to swing the single element typehead assembly 13 toward the platen 14 to print The cycle shaft 34 also carries a second cam 38 operating on a follower 41 rotatably mounted on the shaft 23 to control rotate and tilt detent structures.

With reference to FIGS. 1 and 2, the left support arm 20 pivotally supports a tilt detent lever 42 which is biased by a spring 43 to urge a bent off detent tooth 44 at its end into engagement with notches 45 of a segment 46 secured to the underside of the tilt bridge 18. Initially, the position of the cam 38 is such that the tilt detent lever 42 is held against the bias of its spring 43, as by a rod 47 linked to the cam follower 41, to hold its tooth 44 from detenting engagement with the segment notches 45. The movement of the tilt detent lever 42 also, through its bent off tooth 44, acts on a rotate detent lever 48 which extends through a slot 49 in the tilt bridge 18 and its upper end has a slot 50 into which pivot pin 19 extends. Thus, the rotate detent lever 48 is held down against the bias of a spring 51 connected to the pin 19 and a rotate detent tooth 52 formed on the rotate detent lever 48 thereby to hold the rotate detent tooth 52 from detenting notches 53 formed on the lower edge of the typehead 15. The disengagement of the tilt and rotate detent teeth 44 and 52 allows the typehead 15 to be initially positioned. After positioning of the typehead 15, the detent teeth 44 and 52 are caused to engage the notches 45 and 53 on the tilt bridge and typehead prior to impacting movement of the typehead 15 against the platen 14.

With reference to FIG. 3, the right end of the cycle shaft 34 extends to the right side of the machine and supports on its end a bevel gear 55 which drives a second bevel gear 56 mounted on the upper end of a vertical translator drive shaft 57 which is rotatably supported in the spaced upper and lower walls 58, 59 of the translating mechanism generally designated by reference numeral 61. Rotation of the shaft 57 by the cycle shaft 37 drives an indexing means in the form of a Geneva mechanism generally designated by reference numeral 62 through a series of gears 63–66. The output shaft 67 of the Geneva mechanism 62 is also rotatably supported in the upper and lower walls 58, 59 of the translator mechanism 61 and has secured thereto a cross-shaped member generally designated by reference numeral 68 between the upper and lower walls 58, 59 of the translator mechanism 61. As shown, the cross-shaped member 68 has arms 71, 72, 73 and 74 of equal length extending from the axis thereof at 0°, 90°, 180°, 270° positions, and opposing arms of the cross-shaped member 68 support a set of radially spaced pins. The pin set on opposing arms as viewed in FIGS. 3 and 7, comprises five rotate select pins $R_1$-$R_5$ and two tilt select pins $T_1$, $T_2$ on arm 72, and at the same radial spacing, five rotate select pins $R_1$-$R_5$ and two tilt select pins $T_1$ and $T_2$ on arm 74. An identical set is provided in opposing arms 71, 73. Pins of a set are adapted to be selectively axially displaced upward by selector slides generally designated by reference numeral 75 (FIG. 5) controlled from a keyboard generally designated by reference numeral 76 (FIG. 4) in a manner to be more particularly described.

Figure 5:
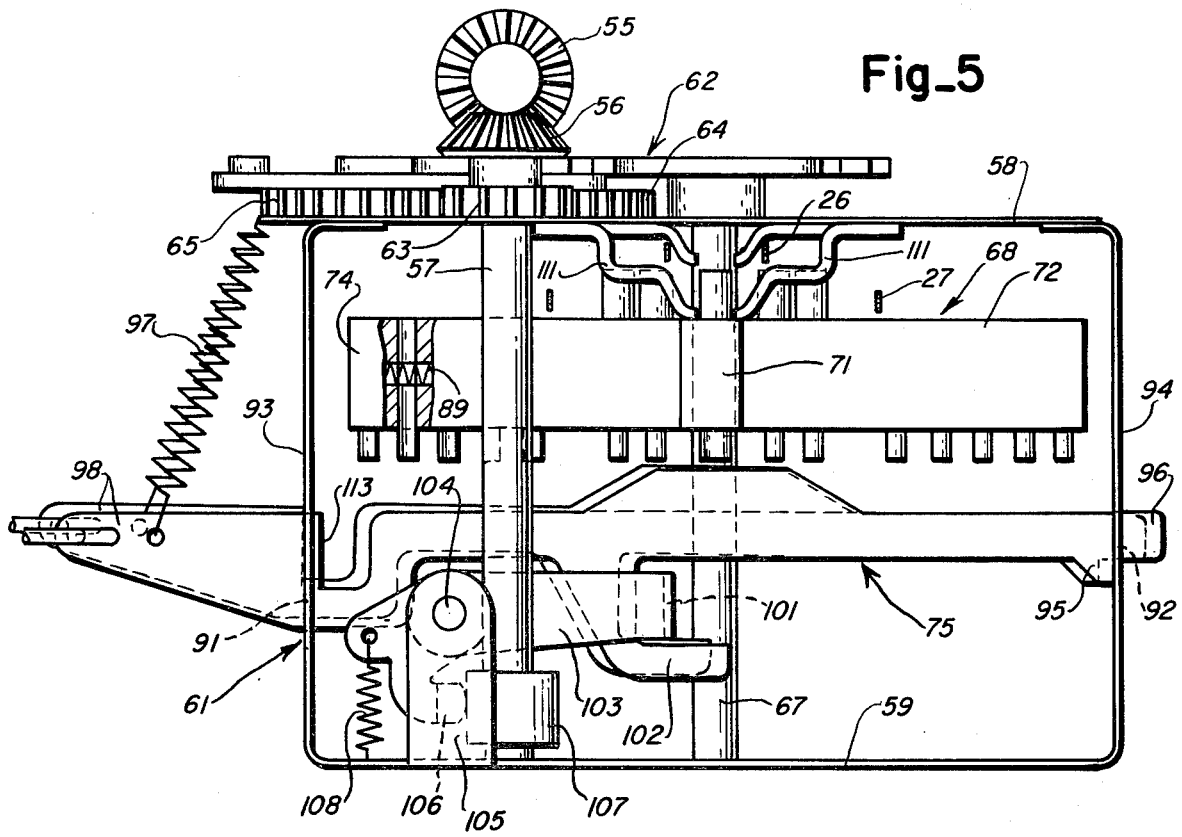
FIG. 5 is a side elevational view of the translator from the right side of FIG. 3.
Figure 7:
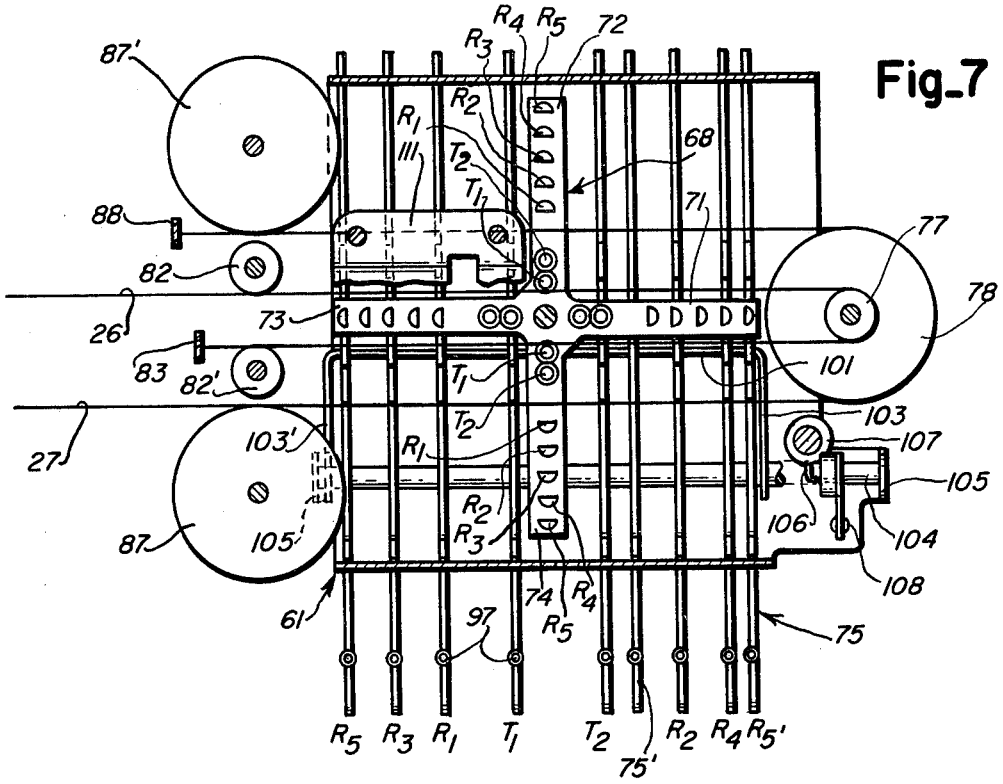
FIG. 7 is a plan view of the cross-member and pulleys.

With further reference to FIGS. 3 and 7, the upper wall 58 of the translator mechanism 61 further rotatably supports on its underside a tilt band turn around pulley 77 and a rotate band turn around pulley 78 which are axially spaced and located above and outwardly of the circle defined by the radius of the arms of the rotatable cross-member 68. As shown in FIGS. 1, 3 and 7, the tilt band 26 connected to the tilt bridge 18 extends around a guide pulley 81 (FIG. 1) and is further directed as seen in FIGS. 3 and 7 by a second guide pulley 82 to and around the fixed pulley 77 and via a guide pulley 82' back to an anchor tab 83 depending from the translator wall 58, thereby forming a loop which is aligned with opposing arms 71, 73. Similarly, the rotate band 27, connected to the pulley 28 rotatably mounted on the head mounting shaft 17 extending upwardly from the tilt bridge 18, extends around a series of guide pulleys 84–86 (FIG. 1) and 87 (FIG. 3) to and around the fixed pulley 78 in the translator mechanism 61 and back on itself via a guide pulley 87' to a fixed anchor tab 88 depending from wall 58. Again, the loop or rotate band 27 is aligned with opposing arms 71, 73 on the cross-shaped member in a plane below the plane of the tilt band loop 26. Normally, the tilt and rotate select pins $R_1$-$R_5$ and $T_1$, $T_2$ in the unset positions are below the plane of the loops as shown in FIG. 5. Detent springs 89, shown in FIG. 5, extending through the arms 71–74 detentably hold the pins in either the set or unset positions. Where the invention is embodied in a movable typehead assembly, the band anchors may be on the movable typehead assembly.

With continuing reference to FIGS. 3 and 5, the translator mechanism 61 has guide slots 91, 92 in the front 93 and rear 94 walls which slidably support the plurality of pin selector slides 75 which are normally held in a rearward latched down position below their associated tilt $T_1$, $T_2$ and rotate $R_1$-$R_5$ pins. The slides 75 are normally biased rearwardly, to the extent permitted by stops 95 adjacent the rearward ends 96, by associated springs 97 coupled to the forwardly extending ends 98 of the slides 75 and to the upper wall 58 of the translating mechanism 61. The restoring movement of the slides 75 from a released or unlatched position to the normal or latched position, shown in FIG. 5, is accomplished by a bail 101 which extends over hooks 102 depending from each of the pin selector slides 75. The bail 101 has side arms 103, 103' which are secured to a shaft 104 which is rotatably supported in side tabs 105 of the translating mechanism 61. Also secured to the shaft 104 is a cam follower 106 which rides on a cam 107 secured to the lower end of vertical shaft 57. The position of the cam 107 in the rest position is such that the shaft 104 and bail 101 are held in a clockwise rocked position shown in FIG. 5 against the bias of a bail return spring 108, with sufficient clearance between the bail 101 and slide hooks 102 to permit the slide 75 to move to unlatched or memory position as shown by one of the slides 75 in FIG. 5.

On initiation of a cycle, the cam 107 will be rotated to allow the bail 101 to move counterclockwise to permit upward movement of unlatched slides 75 by their springs 97 which, after setting in selected pins, are immediately restored by the bail 101 to latched down condition under contorl of the cam 107 thus allowing slides 75 associated with a second character to move to unlatched condition and be held in memory during the first cycle in readiness to set pins when the bail 101 again moves counterclockwise on the next cycle of cam 107.

As seen in FIGS. 5, 6 and 7, pin restoring cams 111 secured to the underside of the translator top wall 58 are located to restore previously selected pins during the latter part of each 90° rotation or just prior to movement of opposing arms formerly at the 90° and 270° positions to the horizontal 180° and 0° positions to allow new character pins to be set in. The pin restoring cams 111 are located to restore pins selected 180° earlier as the cross-arms in the vertical or 90° and 270° positions move to horizontal 0° and 180° positions and are configured to allow passage of and displacement of the tilt and rotate bands 26 and 27 as shown in FIGS. 6 and 7.

Figure 4:
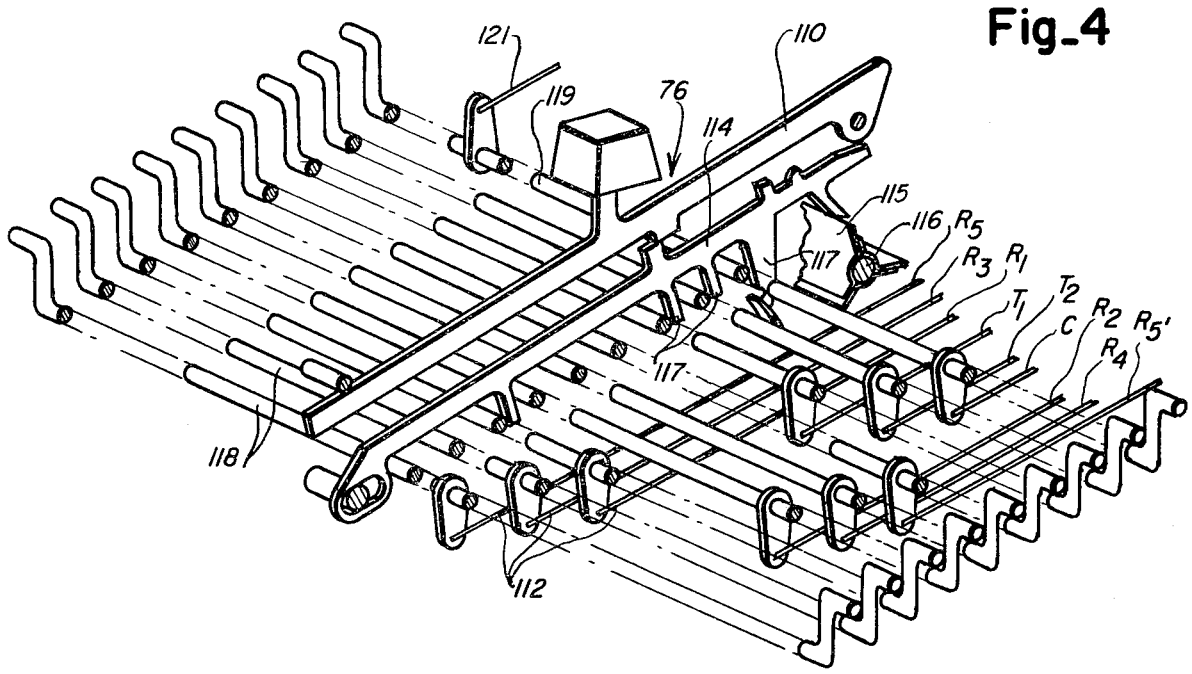
FIG. 4 is a perspective view of an exemplary keyboard for converting key strokes into translatable codes.

As shown in FIG. 4, code signals as from the keyboard are transmitted by way of links 112 connected to pull the pin selector slides 75 forwardly or to the left sufficient to bring notches 113 in the slides below the upper ends of the vertical guide slots 91 in the front wall 93 of the translator mechanism 61 thus unlatching and allowing pin selector slide springs 97 to urge the slides 75 upwardly about their rearward ends into a memory position as shown in FIG. 5 and when the bail 101 is moved counterclockwise as permitted by the cam 107 on shaft 57, to pull the slides 75 upwardly and set associated pins on the horizontally positioned arms moving selected pins axially upward into the plane of the loops of the tilt and rotate bands 26 and 27. As shown in FIG. 7, the initial rotation of cam 107 will allow counterclockwise motion of the restoring bail.

Referring to FIG. 4, there is shown an input code generator in the form of a keyboard having character selection keylevers only one, 110, of which is shown. When depressed, a keylever 110 rocks an associated coded interposer 114 into the path of a flute 115 on a continuing rotating power shaft 116 suitably connected to the motor source 35. This drives the associated interposer 114 forwardly and through depending coded lugs 117 to operate character selection bails 118 and a clutch bail 119. Each of the character selection bails 118 is connected via the links 112 to one of the pin selector slides 75 in the translator mechanism 61. The clutch bail is connected by way of a link 121 to the interponent 37' to momentarily release the single revolution clutch 37 and by way of a second link C to a clutch memory slide 75' in the translator mechanism 61. The parallel connection to the clutch slide 75' will store in memory the fact that a second character has been keyed in during the positioning of first character set in. The clutch memory slide 75' serves, when unlatched, to hold the clutch bail 119 activated so that the cycle clutch will not be disengaged after the first 360° cycle. Thus, another cycle is allowed to follow to effect positioning and printing of a second character keyed in during the first printing cycle.

With reference to FIGS. 8 and 9, there is schematically shown a typehead 15 with 88 characters in four rows, 22 characters in each row, 11lower case and 11 upper case characters located on opposite sides of the typehead 15. The eleven positions on each hemisphere include positions 0–10. Shiftng of the typehead 15 from one hemisphere to the other may be accomplished by a separate conventional band system (not shown). In either hemisphere, the same input code structure may be used.

While any number of code structures and pin arrangements may be used, the following table illustrates a preferred arrangement to rotatively position the typehead to any of the eleven positions and tiltably position the typehead to any of the four positions shown:

| Head Rotate Positions | Input Code Slides $R_1$ | $R_2$ | $R_3$ | $R_4$ | $R_5$ | $R_5$ | Head Tilt Positions | Input Code Slides $T_1$ | $T_2$ |
|---|---|---|---|---|---|---|---|---|---|
| 0 | 0 | 0 | 0 | 0 | 0 | 0 | 0 | 0 | 0 |
| 1 | 1 | 0 | 0 | 0 | 0 | 0 | 1 | 1 | 0 |
| 2 | 0 | 1 | 0 | 0 | 0 | 0 | 2 | 0 | 1 |
| 3 | 1 | 1 | 0 | 0 | 0 | 0 | 3 | 1 | 1 |
| 4 | 0 | 0 | 0 | 1 | 0 | 0 | | | |
| 5 | 0 | 0 | 0 | 0 | 0 | 1 | | | |
| 6 | 1 | 0 | 0 | 0 | 0 | 1 | | | |
| 7 | 0 | 1 | 0 | 0 | 1 | 0 | | | |
| 8 | 0 | 0 | 1 | 0 | 0 | 1 | | | |
| 9 | 0 | 0 | 0 | 1 | 1 | 0 | | | |
| 10 | 0 | 0 | 0 | 0 | 1 | 1 | | | |

In this code arrangement, the keyboard need generate only a one or two combination of six rotate signals and/or a one or two combination of two tilt signals.

As seen in FIG. 7, the cross-member 68 is shown with rotate pins $R_1$–$R_5$ and $T_1$, $T_2$ on each leg 71–74 with the arrangement of 8 selector slides 75 necessary to achieve the pin selection in accordance with the input codes generated by the keyboard.

As indicated in FIG. 7, the six rotate slides 75 are shown as located beneath pins $R_5$, $R_3$ and $R_1$ on the left arm 73 of the horizontally opposed arm 71, 73 and beneath pins $R_2$, $R_4$ and $R_5$ on the right arm 71 of the horizontally positioned cross-member 68. Similarly, the two tilt slides are located beneath pins $T_1$ on the left arm 73 and $T_2$ on the right arm 71 of the horizontally positioned arms 71, 73. While the pins are shown mounted symmetrically and the slides asymmetrically, the invention also contemplates an asymmetric pin arrangement and symmetric slide 75 arrangement.

In operation, the depression of the keylever 110 causes none, one or two rotate code bails 118 and none, one or two tilt code bails 118 to be rocked, together with the clutch bail 119 initiating a cycle at 0° as shown in FIG. 12. Rocked selector bails 118 are operative to release or unlatch associated pin selector slides 75 for upward movement and, as permitted by cam 107, to rise, setting pins on the horizontally opposing arms 71, 73 of the cross-shaped member over the 0°–35° interval, after which the cam 107 restores slides 75 over the 35°–61° interval. The Geneva mechanism following a dwell interval then rotates the cross-shaped member 90° during which the selected pins operate to displace the rotate and tilt bands 27 and 26 to rotatably and tiltably position the typehead 15.

As typehead 15 is being positioned over the interval 35°–270°, the cam 107 on the vertical shaft 67, having restored slides 75 associated with the first character at 61°, slides 75 of the second character may be unlatched and held in memory together with the clutch memory slide 75'. Following the positioning movement of the typehead 15 as at 270°, the cam 38 on the cycle shaft 34 operates the detent structure over the interval 270°–325° to finally position the typehead and the cam 33, which has a drop off, and allows as at 325° the power stored in the power spring to drive the typehead supported structure toward the platen to print as at 338° after which the cams 33 and 38 release the detent structure and return the typehead assembly 13. In the next cycle, the slides 75 in memory, following the bail 101, will rise to select pins in the now horizontally positioned cross-arms 72, 74.

With reference to FIG. 7, if no pins are set in either opposing arm of the 0° and 180° positioned arms, rotation of the cross-member 68 through 90° will not cause displacement of the tilt and rotate bands 26 and 27 and the character on the typehead located at the intersection of the zero tilt and rotate positions will be printed.

Figure 10:
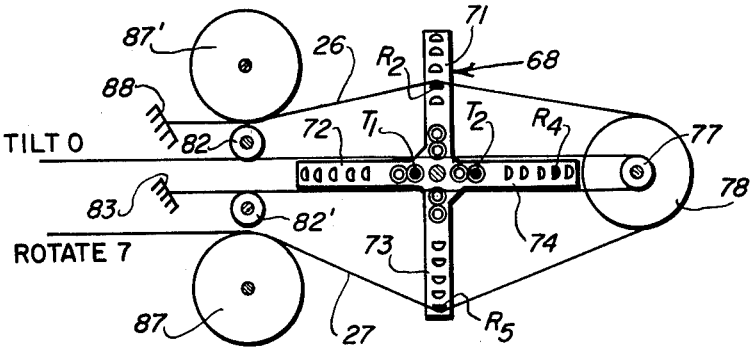
FIGS. 10 and 11 are schematic views illustrating band positioning.

FIG. 10 shows the rotate band 27 diplaced seven increments as by pins $R_5$ and $R_2$ selected in opposing arms 71, 73 incident to 90° rotation of the cross-member 68 to the FIG. 10 position thereby rotating typehead 15 to column position 7. As neither of the tilt pins $T_1$ or $T_2$ was selected when arms 71, 73 were in the horizontal position, no displacement of the tilt band 26 occurs incident to 90° rotation of the cross-member 68 to the position shown in FIG. 10. The character at the column 7, tilt 0 positions, will, therefore, be positioned for printing. FIG. 10 also indicates a second character set in memory as by release of slides $R_4$, $T_1$ and $T_2$ which will be released by bail 101 to select pins $R_4$, $T_1$ and $T_2$ in arms 72, 74 which will displace bands 26 and 27 incident to rotation of arms 72, 74 in the next cycle to the FIG. 11 position.

Figure 11:
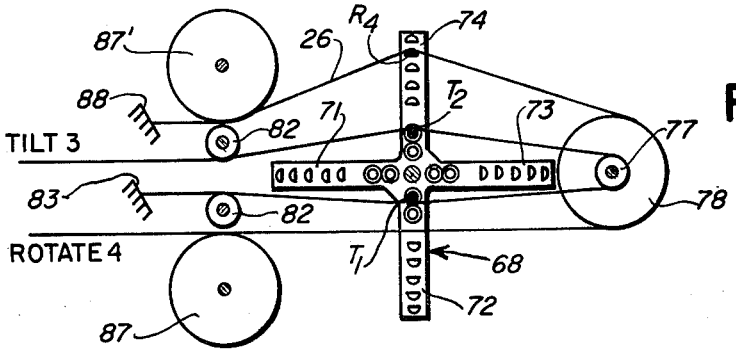

FIG. 11 shows the rotate and tilt bands 26 and 27 displaced to position the typehead 15 at the column 4 tilt 3 positions as by pins $R_4$, $T_1$ and $T_2$ acting thereon following rotation of the cross-member 68 to the FIG. 11 position. Note is to be taken that the movement of the typehead from column 7 tilt 0 position to the column 4 tilt 3 position occurs directly without having to return to the column 0 tilt 0 position.

The non-homing feature of the translator 61 contributes to reliability in that the most frequently used combinations of two or three characters can be positioned on the typing element to minimize forces on the bands and corresponding wear, and the pins necessary to effect positioning of the most frequently used characters can be located closer to the axis of the cross-shaped member 68 to reduce loads on the drawbands.

The invention claimed is:

1. In a machine having a positionable type element and translator mechanism for positioning said type element to any of a plurality of selected coordinate positions in response to coded input signals, means biasing said type element to a zero coordinate position, a rotatably indexable member, a plurality of pins mounted on said rotatably indexable member at locations spaced from the axis of rotation thereof and movable from unset to set positions in an axial direction, at least one band anchored at one end and connected at its other end to said type element, said band being located in the path of movement of for displacement by set pins on and incident to indexing of said rotatably indexable member, means for setting pins in response to input code signals, and means responsive to a printing cycle initiating signal for indexing said rotatably indexible member through 90° whereby set pins will displace said band to position said type element to a selected position incident to indexing movement of said rotatably indexable member.

2. In a machine as recited in claim 1 said rotatably indexable member having opposing pairs of legs disposed at 90° defining a cross-shaped member with said axis of rotation at the juncture of said legs.

3. In a machine as recited in claim 2, said legs being of equal length.

4. In a machine as recited in claim 3 wherein a set of selectable pins are symmetrically mounted in each pair of opposing legs of said cross-shaped member.

5. In a machine as recited in claim 2, a turn around pulley, said band between its ends being trained about said turn around pulley to define a loop extending along horizontally positioned opposing legs of said cross-shaped member.

6. In a machine as recited in claim 1, said means for setting said pins comprising a plurality of code slides having a latched position, a memory position, and an active position, means for generating code signals and a cycle signal for setting selected code slides into memory position, and for initiating a positioning cycle, and means operative during a positioning cycle to allow code slides in memory position to move to active position to set associated pins.

7. In a machine as recited in claim 6, said slides being positioned to set pins in horizontally positioned opposing legs of said cross-shaped member.

8. In a machine as recited in claim 6, including means to restore selected code slides to latched position following setting of associated pins.

9. In a machine as recited in claim 6, including means for restoring set pins in advance of movement of opposing legs to a setting position.

10. In a machine as recited in claim 1, including another band located in the path of movement of selected pins and displaceable with said one band to position said movable type element to a selected coordinate position.

* * * * *